US009030372B2

(12) United States Patent
Desclos et al.

(10) Patent No.: US 9,030,372 B2
(45) Date of Patent: May 12, 2015

(54) N-SHOT ANTENNA ASSEMBLY AND RELATED MANUFACTURING METHOD

(75) Inventors: Laurent Desclos, San Diego, CA (US); Jeffrey Shamblin, San Marcos, CA (US); Seong-Gi Jeong, Gyeonggi-do (KR); Seung-Woong Choi, Gyeonggi-do (KR); Cheol-Hun Seol, Incheon (KR); Won-Sui Lee, Gyeonggi-do (KR)

(73) Assignee: Ethertronics, Inc., San Diego, CA (US)

( * ) Notice: Subject to any disclaimer, the term of this patent is extended or adjusted under 35 U.S.C. 154(b) by 179 days.

(21) Appl. No.: 13/413,427

(22) Filed: Mar. 6, 2012

(65) Prior Publication Data

US 2013/0076571 A1 Mar. 28, 2013

(30) Foreign Application Priority Data

Sep. 26, 2011 (KR) ..... 10-2011-0096954

(51) Int. Cl.

| | |
|---|---|
| ***H01Q 1/40*** | (2006.01) |
| ***H01Q 1/38*** | (2006.01) |
| ***H01P 11/00*** | (2006.01) |
| ***H01Q 1/24*** | (2006.01) |
| ***H01Q 5/00*** | (2006.01) |

(52) U.S. Cl.

CPC ..... *H01Q 1/243* (2013.01); *H01Q 5/0058* (2013.01)

(58) Field of Classification Search

USPC ..... 343/700 MS, 873; 29/600; 430/270.1, 430/311

See application file for complete search history.

(56) References Cited

U.S. PATENT DOCUMENTS

| | | | | |
|---|---|---|---|---|
| 6,137,452 | A * | 10/2000 | Sullivan | 343/873 |
| 2006/0001152 | A1* | 1/2006 | Hu | 257/707 |
| 2006/0017623 | A1* | 1/2006 | Luch | 343/700 MS |
| 2006/0285273 | A1* | 12/2006 | Chang et al. | 361/312 |
| 2008/0036679 | A1* | 2/2008 | Webb et al. | 343/867 |
| 2009/0293604 | A1* | 12/2009 | Sham et al. | 73/146.5 |
| 2011/0080333 | A1* | 4/2011 | Wu et al. | 343/906 |
| 2011/0183082 | A1* | 7/2011 | Hamilton et al. | 427/555 |
| 2011/0183721 | A1* | 7/2011 | Hill et al. | 455/566 |

FOREIGN PATENT DOCUMENTS

| | | | | |
|---|---|---|---|---|
| KR | 10-0756312 | * | 7/2007 | H01Q 5/01 |

* cited by examiner

*Primary Examiner* — Robert Karacsony

(74) *Attorney, Agent, or Firm* — Coastal Patent Law Group, P.C.

(57) ABSTRACT

An antenna module and a manufacturing method for the same are disclosed. With the miniaturization trend for mobile communication terminals, the invention can achieve the miniaturization of antenna modules and facilitate the design of the antenna. The SMD as a matching component for given resonance frequency and impedance matching of the antenna is mounted on the antenna module to make the antenna module compact, and functions as a matching circuit for impedance matching to facilitate the design of mobile devices.

21 Claims, 8 Drawing Sheets

N-SHOT ANTENNA ASSEMBLY AND RELATED MANUFACTURING METHOD

BACKGROUND OF THE INVENTION

1. Field of the Invention

This invention relates to wireless communications; and more particularly to an antenna for installation within a wireless communications device, and a manufacturing method of the same.

2. Description of the Related Art

In recent years, the field of wireless communications, including information technology (IT), has improved with the advent of the full-fledged information age, and there have been introduced various mobile devices such as cellular phones, digital cellular system (DCS), personal communication service (PCS), wideband code division multiple access (WCDMA), 4G long term evolution (LTE) phone, personal digital assistant (PDA) terminals, global positioning systems (GPS), smart phones, and notebook computers, among others, to provide a variety of services to users through wireless data communication.

An antenna such as helical antenna or dipole antenna is typically mounted on these mobile devices so as to enhance transmission intensity and receive sensitivity. These antennas, as an external antenna, are protruded to the outside of wireless communication terminals.

While the external antenna has useful radiation characteristics, being external to the mobile device presents problems such as breakage during normal use, de-tuning of the antenna due to direct contact with the user, and a negative impact on appearance and aesthetics.

As solutions to the abovementioned drawbacks, a flat internal antenna, such as a micro strip patch antenna or inverted F-type antenna, has been mounted within the terminal without protrusion to the outside thereof.

In general, the conventional internal antenna comprises a body molded with an insulator such as polycarbonate and a conductive pattern formed using a metal plate or etched conductive pattern on a flex circuit, for example, wherein the conductive pattern includes a circuit pattern capable of wireless transmission and reception in a specific frequency band and is coupled with the surface of the body.

To manufacture the internal antenna, there have been provided metal stamping method for punching a desired pattern into a metal piece and fusing the metal piece onto the molded body by heat, an etching method for plating the entire mold and eliminating the rest of mold except for the pattern; and a printing direct structuring (PDS) method for plating after directly printing the molded body with conductive ink.

The internal antenna is designed to transmit and receive the signal of a predetermined frequency band. In other words, the antenna may radiate the signal by resonance at a fixed frequency band.

In general, electrical characteristics of an antenna, such as radiation pattern, gain, bandwidth, frequency, polarization, and impedance, can be configured by varying the antenna design. For example, impedance of the antenna can be configured by providing a matching component such as a capacitor or an inductor. In conventional antennas, since matching components and antenna characteristic values are fixed, there is a problem that the new tuning of an internal antenna is required when the characteristic of antenna needs to be changed in the design process.

In other words, to obtain desired electric characteristics of the antenna, the conventional internal antenna requires a change in the design structure of the antenna through tuning according to the conditions of various systems, or to change the conditions of the system according to the characteristics of antenna. These limitations introduce added costs in the development process as well as difficulties in management of the product due to the development of various products.

To solve these problems, commonly owned Korean Patent Registration No. 10-0756312, entitled "RESONANCE FREQUENCY AND INPUT IMPEDANCE CONTROLLABLE MULTIPLEX BUILT-IN ANTENNA" discloses a built-in internal antenna, wherein the built-in antenna has one feeding point, two shorting points, and an inductor therebetween so as to control resonance frequency and input impedance.

In the above patent, however, there is a difficulty in process to install the inductor between the shorting point and the ground plane and it is difficult to install the built-in antenna with a PCB. Moreover, since only the inductor value is controlled from the outside of the built-in antenna, other electric characteristics of the built-in antenna are fixed.

SUMMARY OF THE INVENTION

In one aspect of the invention, a manufacturing method is provided for the fabrication of internal antennas in accordance with various embodiments of the invention.

In one embodiment, the manufacturing method comprises: molding a carrier to have one or more negative patterns, or "voids", disposed along an outer surface thereof, the carrier being formed from a non-conductive and plating-resistive material, the voids essentially comprising a cavity extending along a conductor pattern which will ultimately become the conductive portions of the antenna; filling the voids of the carrier with a plating-friendly material; forming a plating resist for resisting a subsequent conductive plating to form a discontinuous part separating portions of the conductor pattern; plating a conductive material on the plating-friendly material to form one or more conductive portions along the conductor pattern of the carrier; and attaching a surface mounted device (SMD) such that terminal ends of the SMD are connected with the conductive portions adjacent to the discontinuous part of the conductor pattern. This method can be referred to herein as a dual-shot antenna forming technique since the method requires first molding a plating-resistive carrier having voids in the pattern of desired conductive portions, and second injecting a plating-friendly material within the voids of the carrier prior to plating the carrier.

In various embodiments, the method may comprise forming two or more plating resists for forming two or more discontinuous parts in the conductor pattern; and attaching multiple SMD's wherein one or more SMD's are disposed in a manner for connecting adjacent conductive portions separated by each discontinuous part of the conductor pattern. Moreover, one or more SMD components may be connected to radiating portions of the antenna.

In another embodiment, a dual-shot antenna forming technique as described above is used to form a first layer of a three-dimensional antenna structure; a second layer of the three-dimensional antenna structure is independently formed; and the first and second layers are combined to form a multi-layer antenna assembly.

In certain embodiments, the first layer of the three-dimensional antenna structure comprises a first dielectric material having at least a first dielectric constant associated therewith, and the second layer comprises a second dielectric material having at least a second dielectric constant, wherein the second dielectric constant is different from the first dielectric constant such that the multi-layer antenna comprises a dielectric gradient.

In another embodiment, the manufacturing method further comprises coupling at least one active element to a conductive portion of the antenna for actively tuning the conductive portion.

In another aspect of the invention, an antenna assembly is provided in accordance with the manufacturing methods of the invention. The antenna assembly comprises one or multiple layers, wherein at least one of the multiple layers comprises a carrier volume having one or more voids extending along a conductor pattern, a filler volume disposed within the voids, a conductive material overlaying at least one surface of the filler volume forming a conductor pattern, and at least one SMD attached to the conductor pattern. The carrier volume consists essentially of a non-conductive and plating-resistive material, and the filler volume consists essentially of a non-conductive and plating-friendly material.

Various other features and embodiments of the invention are further described within the following detailed description of the preferred embodiments.

DETAILED DESCRIPTION OF THE PREFERRED EMBODIMENTS

Figure 1:
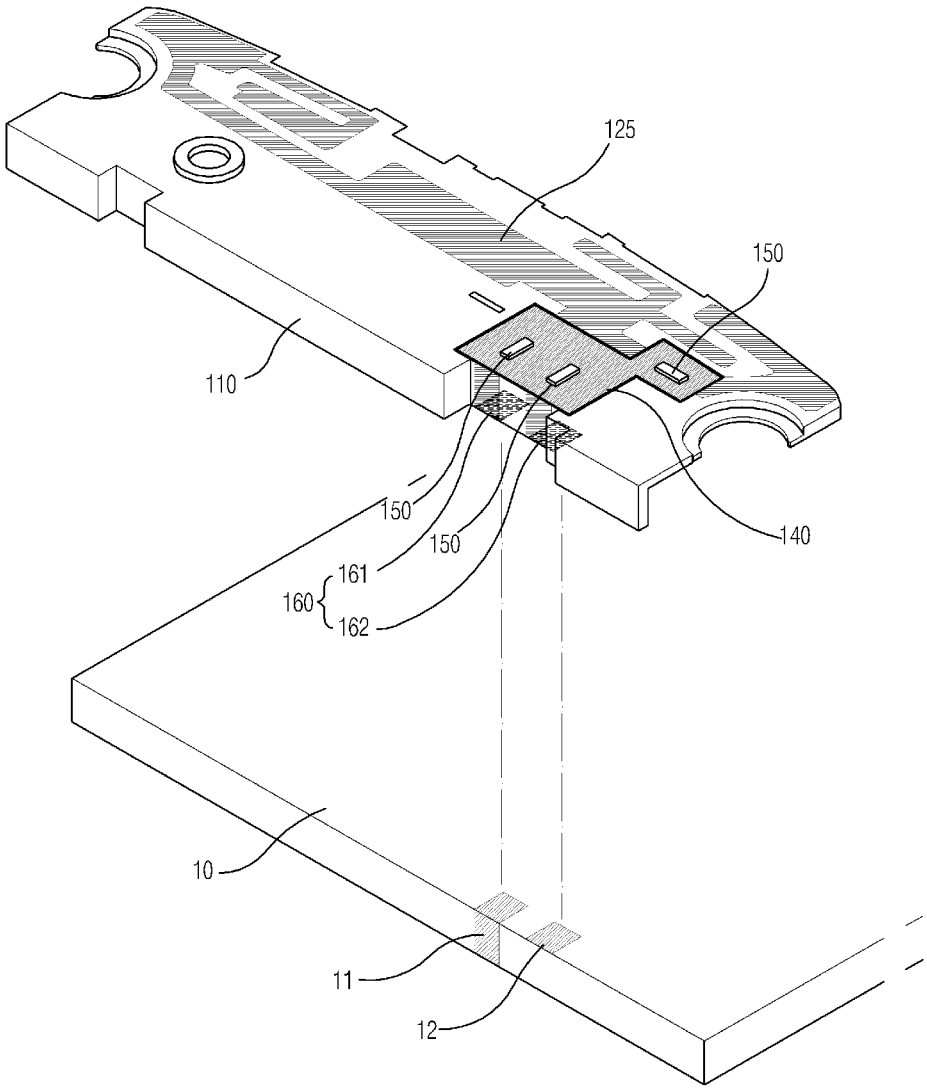
FIG. 1 is a perspective view illustrating an antenna module mounted on a printed circuit board (PCB) of mobile device according to one embodiment of the present invention.

Various features and advantages of this invention will become apparent from the following description of embodiments with reference to the accompanying drawings. Hereinafter, a preferred embodiment of the present invention will be described in more detail referring to the drawings and reference numerals associated thereof.

Accordingly, with the miniaturization trend for mobile communication terminals, the invention can achieve the miniaturization of antenna modules and facilitate the design of the antenna. The surface mounted device (SMD) as a matching component for given resonance frequency and impedance matching of the antenna is mounted on the antenna module to make the antenna module compact, and functions as a matching circuit for impedance matching to facilitate the design of mobile devices.

Additionally, in the application of a passive matching circuit, PCB manufacturers can manufacture the PCB regardless of input impedances of antennas. In a design process, it may occur that the antenna has to be retuned for some reason. In this situation, antenna characteristics may be changed with the SMD as a matching component of the antenna. The SMD is configured by the combination of inductors (L) and capacitors (C), and adjusts capacitive and inductive properties to remove the necessity for special antenna tuning even when the design of the PCB is changed. The SMD may comprise one or more capacitors, inductors, resistors, diodes, active components, or switches Further, active components can be installed on the conductive pattern of the antenna assembly to provide an integrated solution for an active tunable antenna. A flex circuit can be attached to the antenna assembly to bring voltage supply and control signals to the active component. Alternately, conductive patterns can be positioned on the side wall of the antenna assembly to provide a connection with the PCB of the host device to provide supply voltage and control signals to the active component.

For purposes of this invention, the SMDs used in the antenna may include any passive component, such as a capacitor or inductor, or any active component, such as a tunable phase shifter, veractor or vericap diode, tunable capacitor, switch, or other similar active component. In the embodiments including active components, a control signal will be required and thus may be provided by way of a flex-circuit with voltage control, or using baseband signaling.

Further, in the application of an active matching circuit, operations at a desired frequency level can be implemented by positioning the SMD on a specific antenna radiation pattern. The SMD may include one or more inductors and/or capacitors, and may further be configured to adjust the amount of inductors and capacitors so as to acquire optimum signal sensitivity for desired band characteristics.

Further, the size and shape of the antenna may be constantly maintained irrespective of the ambient conditions and location where the antenna is installed, and all electrical characteristics including antenna impedance as well as desired frequencies and operation band may be controlled by using the component of the SMD having various capacitance and inductance values.

Still further, in certain embodiments an antenna radiation pattern is formed by plating, and more specifically, it can be simply formed through dual shot molding and electroless plating, although generally any plating technique can be used with minor adjustment to the process.

For purposes of this invention, the terms antenna module, antenna assembly, and antenna are intended to be interchangeably applicable throughout the description. More particularly, in several embodiments an antenna may comprise a modular molded and plated structure in the form of an antenna module, or may be a multi-layered module combined as an assembly of multiple parts.

Now turning to the examples as illustrated in the appended drawings, certain antennas and methods are demonstrated to enable those having skill in the art to make and use the invention. Certain deviations from the provided examples are expected, and may be practiced without undue experimentation when exercised by those having ordinary skill in the art, thus the claimed invention is not intended to be limited by the scope of the following illustrative examples.

Built-in Antenna Assembly

Figure 2:
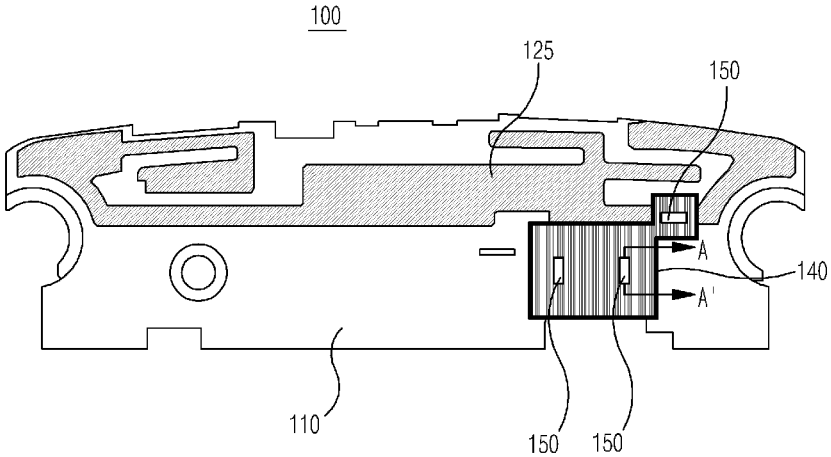
FIG. 2 is a plan view showing an antenna module according to one embodiment of the present invention.
Figure 3:
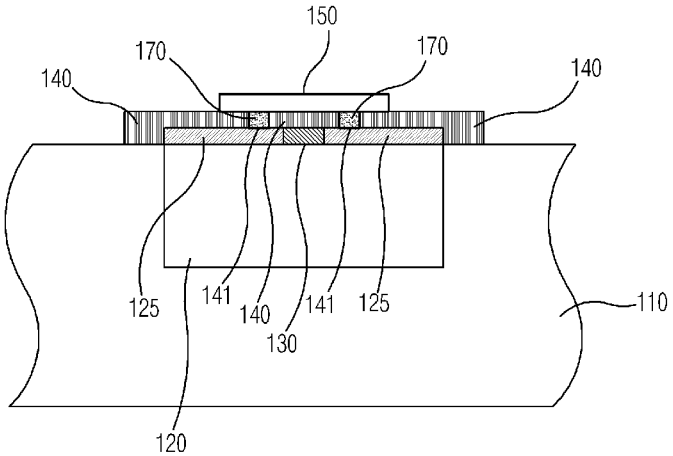
FIG. 3 is a sectional view taken along the line A-A' in FIG. 2.

FIGS. 1-3 illustrate an antenna assembly according to various embodiments of the invention. FIG. 1 is a perspective view illustrating an antenna module for mounting on a printed circuit board (PCB) of mobile wireless device according to various embodiments of the invention. FIG. 2 is a top plan view showing an antenna module according to the embodiment of FIG. 1. FIG. 3 is a sectional view taken along the line A-A' in FIG. 2.

Referring now to FIGS. 1 to 3, an antenna module 100 is adapted for installation on a Printed circuit board (PCB) of mobile wireless device.

The antenna module 100 comprises a carrier 110 which is made of non-conductive and plating-resistive resin material. The carrier further comprises one or more voids extending along a negative conductor pattern on an outer surface of the carrier. The voids of the carrier further comprise a filler material 120 spanning a volume thereof, the filler material 120 being plating-friendly. One or more plating resists 130 are disposed on an exposed surface of the filler material and adapted to resist plating and form a discontinuous part of the conductor pattern. A conductive material is plated on the remaining exposed surface of the filler material 120 and extends along the filler material surface to form the conductive pattern 125. The conductive pattern 125 may have various shapes according to various designs.

Since plating resists 130 are formed between lines of the conductive pattern 125, a discontinuous part of the conductive pattern lines exists.

Preferably, the conductive pattern 125 has a three dimensional shape where a curved part is formed in the outer portion thereof, and has at least one connecting pin 160 downwardly bent and extended from one side of the conductive pattern. When assuming that the conductive pattern 125 has two connecting pins 160 as shown in FIG. 1, one of the connecting pins 160 functions as a feeding pin 161 being connected to an RF connector of the PCB 10 and the other one functions as a ground pin 162 being grounded by the medium of the PCB. When the antenna module 100 with the conductive pattern 125 is mounted on the PCB, the feeding and ground pins 161,162 are respectively in contact with feeding and ground lines 11, 12 on the PCB.

An antenna contact device may be interposed between the antenna module 100 and the PCB. In other words, the antenna contact device is formed in a "C" shape to have elasticity, a flat lower part is fixed to the feeding and ground lines 11,12 of the PCB 10, and an upper bent part is elastically in contact with the connecting pin 160 of the antenna module 100.

At least one surface mounted device (SMD, 150) capable of electrically connecting a discontinuous part and adjusting electrical characteristics is interposed between the lines of the antenna conductive pattern 125. The SMD 150 is mounted to connect the conductive patterns 125 on both sides of the plating resists 130 at the discontinuous part of the antenna conductive pattern 125.

In certain embodiments, a solder mask 140 having open areas 141 can be formed in a portion where the SMD 150 is mounted.

An input/output terminal unit of the SMD 150 is electrically connected with the conductive pattern 125 through a solder bump 170 in the open area 141 of the solder mask where the conductive pattern 125 is exposed, thereby giving electrical continuity to the conductive pattern 125 as well as controlling electrical characteristics of the antenna.

The SMD 150 mounted in the antenna module according to the present invention functions as follows:

First, depending on the miniaturization of mobile communication terminals, it may achieve miniaturization of the antenna module and facilitate the design thereof. The SMD as a matching component for given resonance frequency and impedance matching of the antenna is mounted on the antenna module to make the antenna module compact, and functions as a matching circuit for impedance matching to facilitate designs.

Second, in the application of a passive matching circuit, it enables PCB manufacturers to manufacture the PCB regardless of input impedances of antennas. In a design process, it can occur that the antenna has to be retuned for some reason. In this situation, antenna characteristics may be changed with the SMD as a matching component of the antenna. The SMD is configured by the combination of inductors (L) and capacitors (C), and adjusts inductive and capacitive values to remove the necessity for special antenna tuning even when the design of the PCB is changed.

Third, in the application of an active matching circuit, operations at a desired frequency level can be possible by positioning the SMD on a specific antenna conductive pattern. The SMD may include an inductor or capacitor and is adapted to adjust the amount of reactance so as to acquire optimum receive sensitivity for desired band characteristics.

Dual-Shot Manufacturing Method

Hereinafter, there will be described a manufacturing method for an antenna module according to one embodiment of the present invention.

FIGS. 4 to 8 illustrate manufacturing methods for an antenna module according the various embodiments of the present invention.

Figure 4:
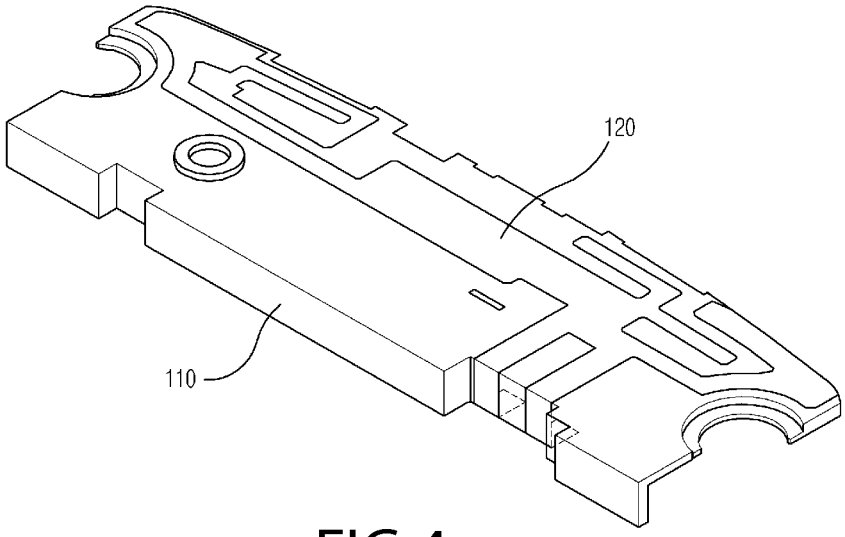
FIGS. 4 to 8 are drawings showing manufacturing methods of the antenna module according to one embodiment of the present invention.

Referring to FIG. 4, a carrier 110 is formed with non-conductive and plating-resistive resin material by injection molding in a mold, or a similar technique. In the outer surface of the carrier 110, a negative pattern, or void pattern, is formed. The void pattern may be formed by providing ridges in the mold used to mold the carrier, or by stamping, laser etching or similar techniques. For the plating-resistive resin material, polycarbonate (PC), polyamide (nylon), and other similar plating-resistive materials may be used. Then, plating-friendly resin material, or a filler material, is injected into the void pattern formed on the outer surface of the carrier 110. In this regard, the void pattern is injected or otherwise filled with a filler material 120 in preparation for plating a conductive material thereon to form a conductive pattern. In general, for the plating-friendly resin material, acrylonitrile-butadiene-styrene (ABS) resin material may be used.

Figure 5:
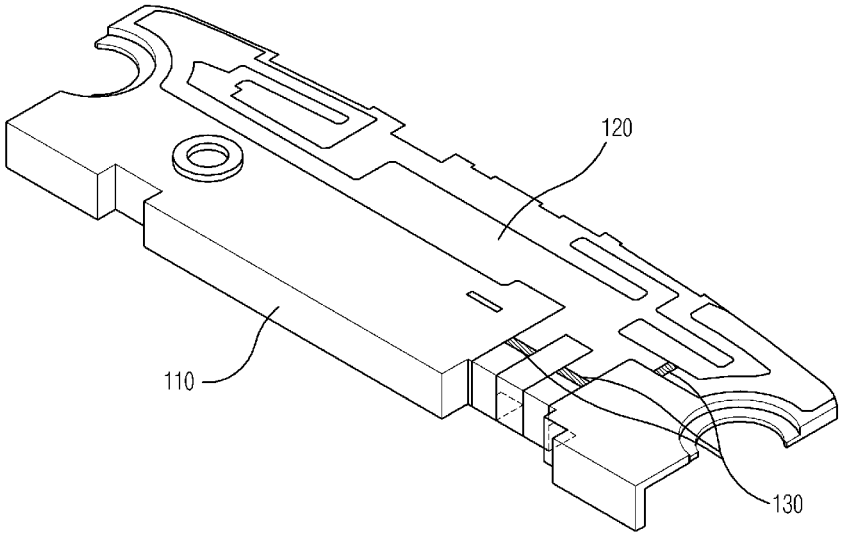

Referring to FIG. 5, on the pattern of filler material 120 at the portion where the SMD is mounted, plating resists 130 are deposited for preventing conductive plating and forming a discontinuous part in the pattern. The plating resists 130 can include a film for preventing the plating at a coated portion, and may function as a screen. For the plating resists, dry film type photosensitive polymer resists may be used.

Figure 6:
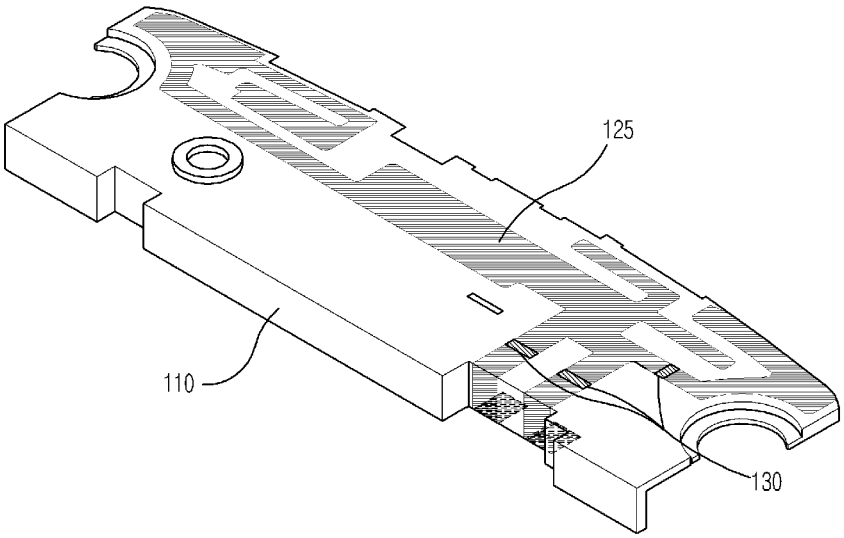

Referring to FIG. 6, through a step of plating conductive material onto the exposed filler material 120 by dipping that into a vessel containing solution of conductive material and draining that, an antenna conductive pattern 125 is formed. At this point, since there is no plating on the plating resists 130, the conductive pattern 125 may have a discontinuous part. Then, the discontinuous part is electrically connected by the SMD. The plating can be electroless plating, and for example, may form copper (Cu), nickel (Ni), and gold (Au) sequentially. The electroless plating is a method for plating metal onto the exposed plating-friendly filler material 120 by autocatalytically reducing metal ions within aqueous solution of metal salt by the force of reducing agents without the supply of electric energy from the outside.

Figure 7:
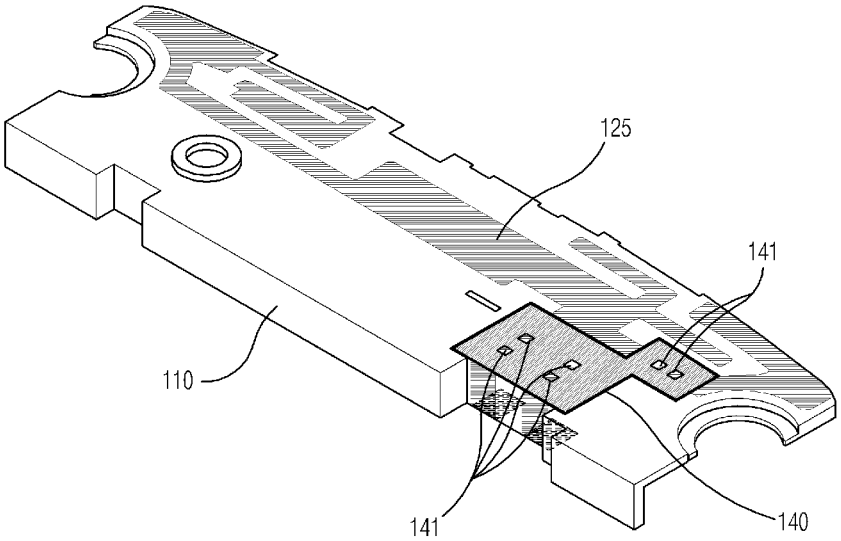

Referring to FIG. 7, a solder mask 140 having an open area 141 is formed. The open areas 141 are portions where conductive patterns 125 adjacent to the plating resists 130 and the discontinuous part are exposed, and also a portion where a terminal unit of the SMD is coupled by the solder bump. In a lower part of the solder mask 140 between the open areas 141, the plating resists 130 and the discontinuous part is disposed.

Figure 8:
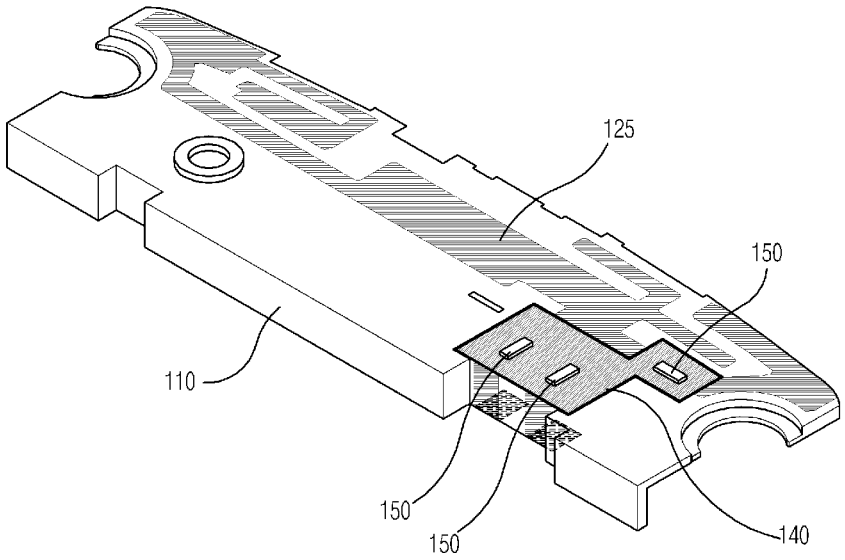

Referring to FIG. 8, on the open areas 141 where the conductive patterns 125 are exposed, the solder bump (not shown) and input/output terminals of the SMD 150 are aligned, and then the procedure advances to a reflow process at a temperature where the solder bump can be melt in order to connect the SMD 150 with the conductive pattern 125 through the solder bump. In order words, by mounting the SMD 150, the discontinuous part of the conductive pattern 125 is continuously connected through the terminal unit of the SMD 150.

Other Examples

Figure 9:
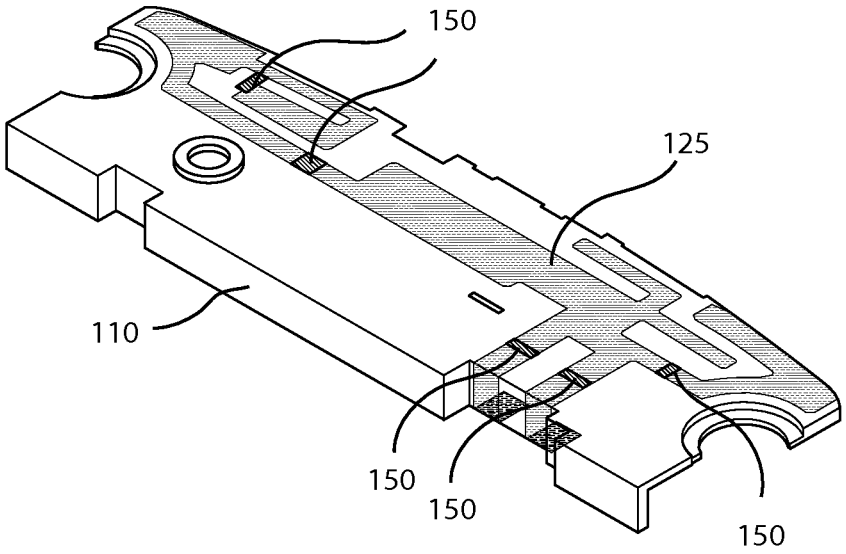
FIG. 9 illustrates an embodiment of the invention, wherein SMD components are coupled to radiating portions of the conductive pattern for adjusting characteristics of the antenna.

In another embodiment as illustrated in FIG. 9, one or more SMD components 150 can be mounted at locations on radiating portions of the antenna element to provide the capability to reactively load portions of the radiating structure or to connect or disconnect portions of the radiator. In this regard, the SMD components 150 can be mounted as described above, i.e. by attaching plating resists and forming a discontinuous part in the conductive pattern and using a soldering technique to attach the SMD components to adjacent portions of the conductive pattern at the discontinuous part.

The SMDs 150 can be individually selected from passive and active components as described above, depending on the design requirements for the antenna.

Figure 10:
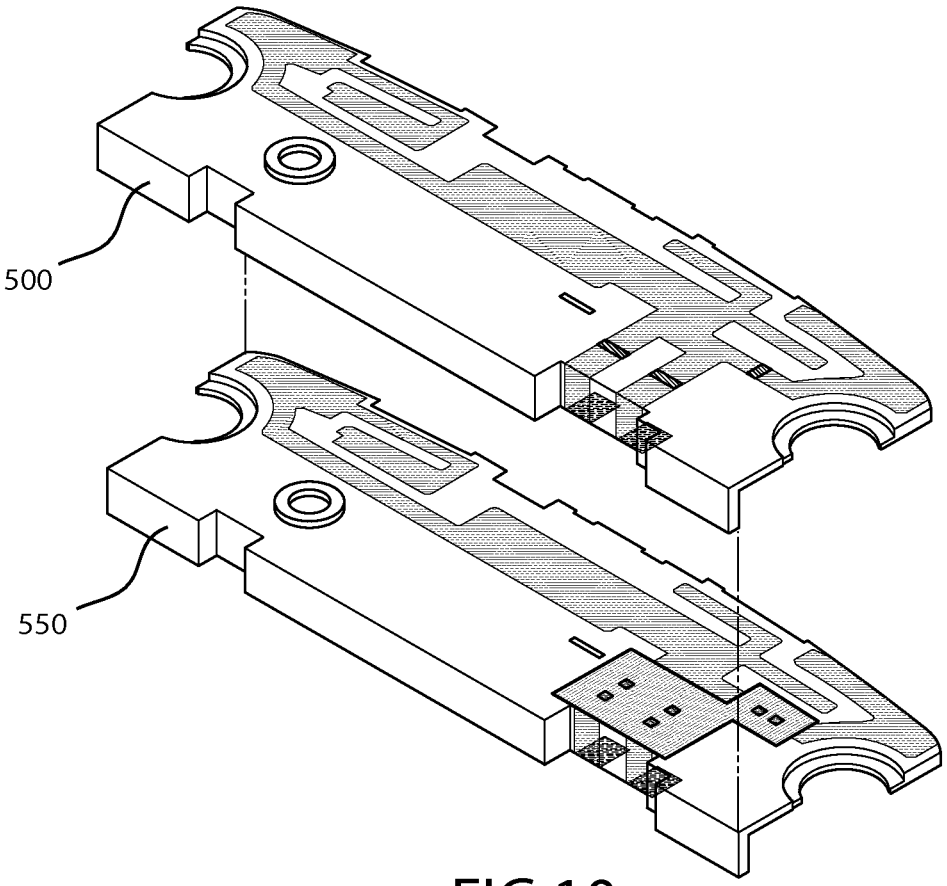
FIG. 10 illustrates a multi-layer antenna assembly according to various embodiments of the invention.

In another embodiment as illustrated in FIG. 10, the manufacturing method can be expanded to include an "n" shot concept, wherein multiple plastic layers are metalized and stacked to provide multiple conductive patterns displayed in several layers across three dimensions. This will provide an antenna assembly which more optimally utilizes the volume allocated for the antenna. Moreover, in addition to driven conductive patterns, one or more parasitic conductor patterns may be disposed within one or more layers of the multi-layer stacked antenna.

Generally, at least a first layer 500 of a multi-layer antenna comprises an antenna carrier manufactured by the above "Dual Shot Manufacturing Method". A second layer 550 is independently fabricated using the dual-shot technique, or other technique. The first and second layers are then combined, for example by nesting the first layer with the second layer, to form a three-dimensional multi-layer antenna assembly.

Figure 11:
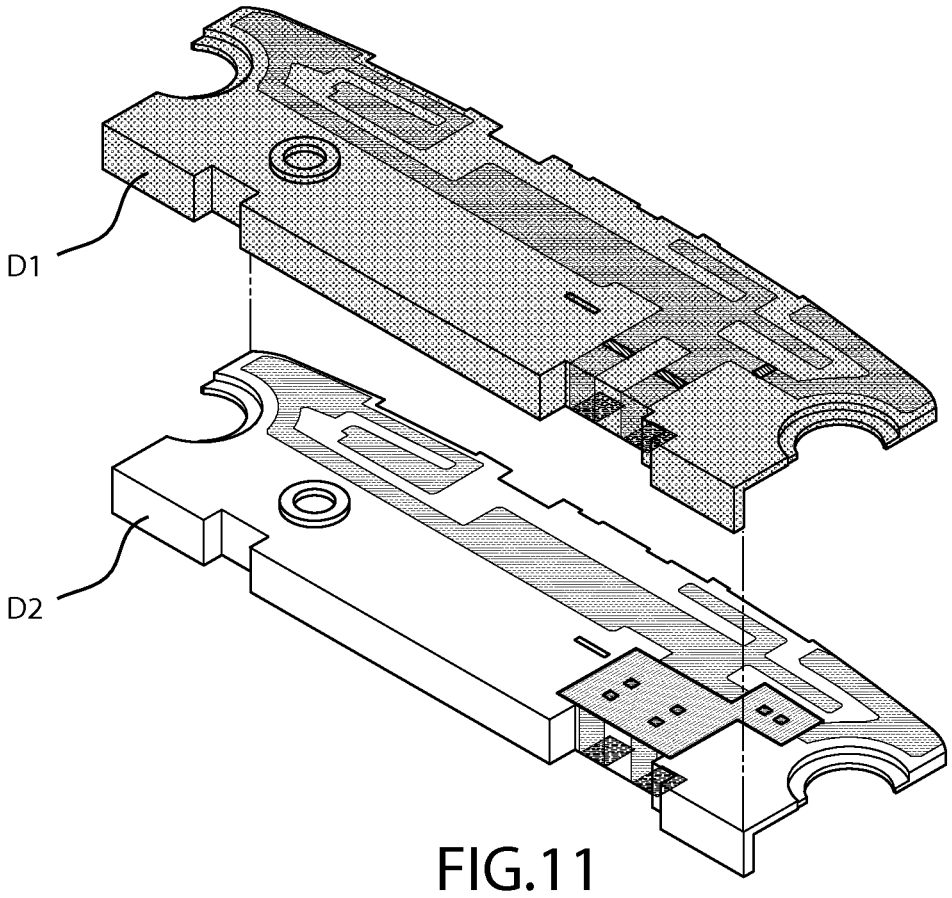
FIG. 11 illustrates a multi-layer antenna assembly having distinct dielectric constants defined at each layer of the multi-layer antenna assembly.

In another embodiment as depicted in FIG. 11, an antenna assembly is fabricated wherein multiple layers are stacked and metalized to provide multiple conductive patterns displayed in three dimensions. A first of the multiple layers comprises a first material having a first dielectric constant D1 and a second layer comprises a second material having a second dielectric constant D2, wherein the second dielectric constant is different than the first dielectric constant. In this regard, up to each layer of the multiple layers of the antenna may comprise a unique dielectric constant, thereby forming a dielectric gradient. Varying the dielectric constant of the multiple layers provides another parameter for optimizing the antenna assembly.

In another embodiment, a conductive portion of the second layer of the multi layer antenna assembly can be connected to at least one conductive portion of a first layer of the multi-layered antenna assembly. The connection can be made using conductive plating or can be made by inserting a conductive element such as a wire, post, or strap.

In another embodiment, a flexible circuit (flex circuit) comprising one or more conductive traces can be attached to the antenna assembly for providing one or more of: voltage, current, and control signals to components attached to the antenna assembly.

Figure 12:
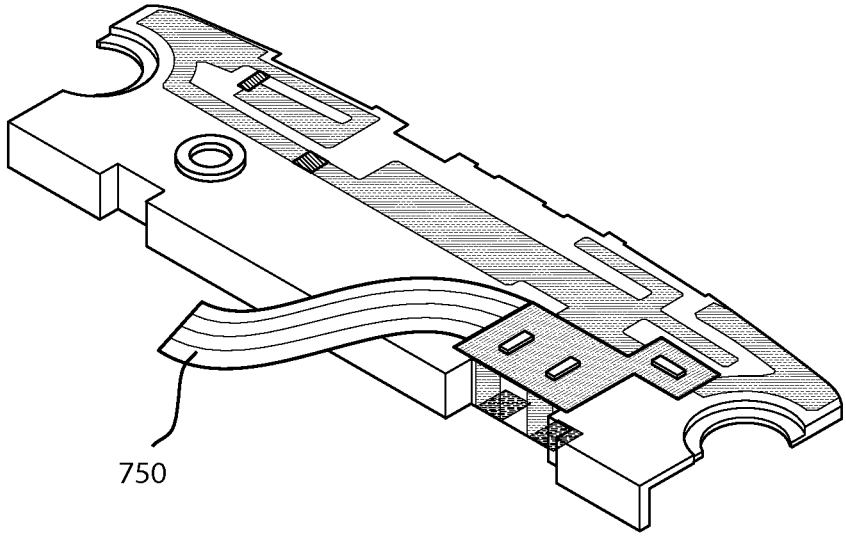
FIG. 12 illustrates an antenna assembly comprising a flex circuit for providing control adjustment to various components of the antenna in accordance with various embodiments of the invention.

In another embodiment as illustrated by FIG. 12, an antenna assembly is provided wherein at least one active component is attached conductive patterns on the antenna. A flex circuit 750 is connected to conductive patterns of the antenna assembly and is used to provide supply voltage and/or control signals to the active component.

One having skill in the art would recognize various methods for connecting a flex-circuit to the one or more SMD components, either by providing a conductive pattern that is suitable for attaching to a flex-circuit, or using a wire connection, etc.

Figure 13:
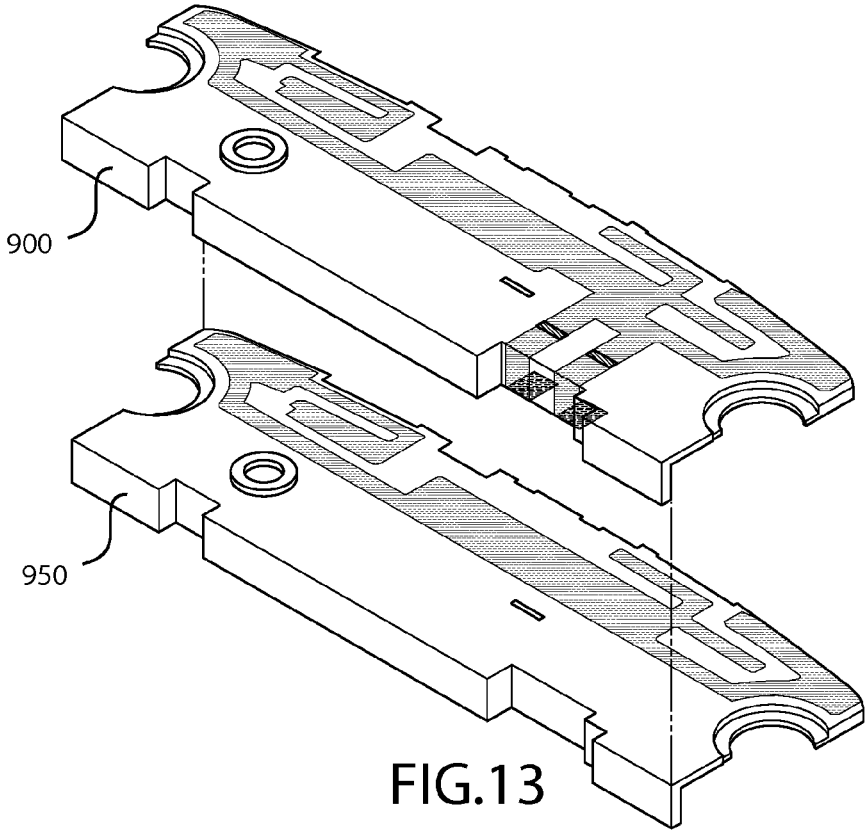
FIG. 13 illustrates an LDS assembly positioned below a dual-shot assembly to form a multi-layer antenna assembly according to various embodiments of the invention; the dual-shot layer comprising one or more SMD components on an outer surface.

In another embodiment as illustrated by FIG. 13, the antenna may comprise a combination of a laser directed structured (LDS) assembly 950 and a dual-shot assembly 900 (as described above), wherein the LDS assembly is first configured and the dual-shot assembly is positioned on top of the LDS assembly. The dual-shot assembly has one or multiple components attached to conductive features.

Figure 14:
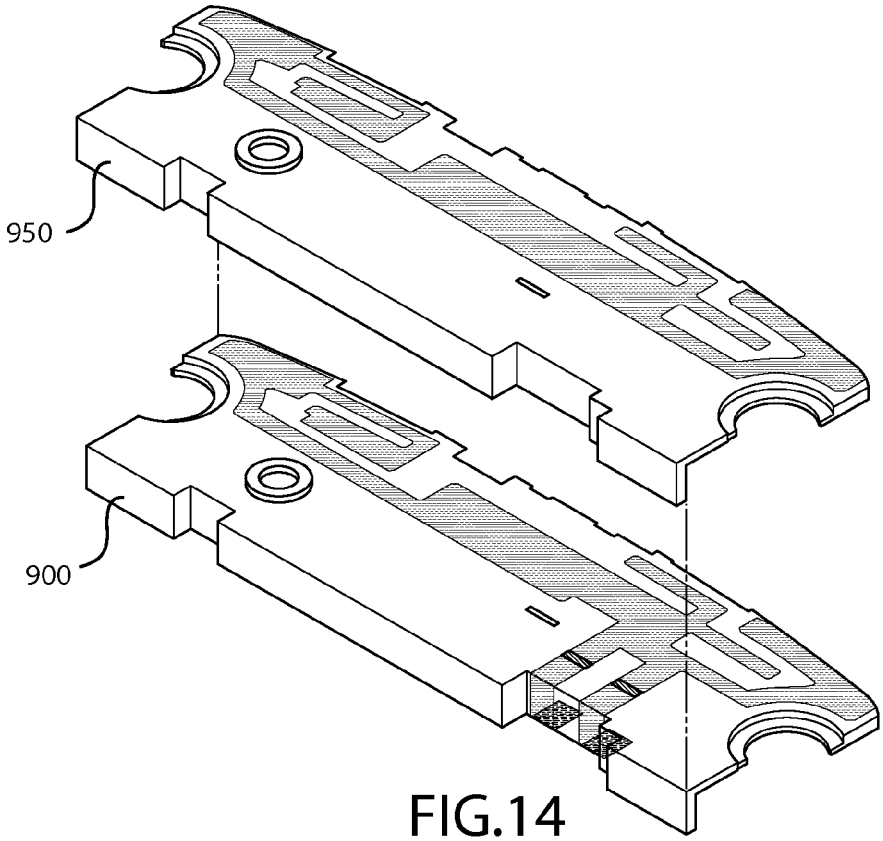
FIG. 14 illustrates an LDS assembly positioned above a dual-shot assembly to form a multi-layer antenna assembly according to various embodiments of the invention.

In yet another embodiment as depicted by FIG. 14, the antenna may comprise a combination of a laser directed structured (LDS) assembly 950 and a dual-shot assembly 900 (as described above), wherein the dual-shot assembly is first configured and the LDS assembly is positioned on top of the dual-shot assembly. The dual-shot assembly has one or multiple components attached to conductive features.

Then, not shown in drawings, to improve adhesive reliability of the solder bump and the radiation pattern, underfill materials (for example, epoxy based adhesive materials filled with SiO2) are dispensed, and curing is performed to harden the underfill materials with heat. By the above mentioned processes, an antenna module is formed. Further, a coating layer may be formed on the carrier where the conductive pattern is formed.

| Listing of Major Symbols in the Drawings | |
|---|---|
| 10: PCB | 11: feed line |
| 12: ground line | 100: antenna module |
| 110: carrier | 120: plating-friendly filler material |
| 125: conductive pattern | 130: plating resists |
| 140: solder mask | 141: open area |
| 150: surface mounted device | 160: connecting pin |
| 161: feeding pin | 162: ground pin |
| 170: solder bump | |

What is claimed is:

1. An antenna assembly for use in wireless devices, comprising:

a carrier formed of non-conductive and plating-resistive resin material, and having one or more voids disposed on an outer surface thereof;

plating-friendly filler material spanning a volume created by the voids on the outer surface of the carrier;

conductive material disposed on a plated surface of the filler material forming a conductive pattern;

a plating resist disposed on the filler material forming a discontinuous part of the conductive pattern; and at least one surface mounted device attached to the conductive pattern at said discontinuous part.

2. The antenna assembly of claim 1, further comprising a solder mask having open areas in a portion for receiving the surface mounted device, wherein an input/output terminal of the surface mounted device is electrically connected with conductive patterns through a solder bumper in an open area of the solder mask where the conductive patterns are exposed for providing electrical continuity to the conductive patterns.

3. The antenna assembly of claim 1, said antenna assembly comprising multiple layers;

a first of said layers comprising:

a first carrier formed of non-conductive and plating-resistive resin material, and having one or more first voids disposed on an outer surface thereof;

a first plating-friendly filler material spanning a volume created by the first voids on the outer surface of the first carrier;

first conductive material disposed on a plated surface of the first filler material forming a first conductive pattern;

a first plating resist disposed on the first filler material forming a first discontinuous part of the first conductive pattern; and a first surface mounted device attached to the first conductive pattern at said first discontinuous part; and a second of said layers comprising:

a second carrier formed of non-conductive and plating-resistive resin material, and having one or more second voids disposed on an outer surface thereof;

a second plating-friendly filler material spanning a volume created by the second voids on the outer surface of the second carrier;

second conductive material disposed on a plated surface of the second filler material forming a second conductive pattern;

a second plating resist disposed on the second filler material forming a second discontinuous part of the second conductive pattern; and a second surface mounted device attached to the second conductive pattern at said second discontinuous part.

4. The antenna assembly of claim 3, the first layer of said multiple layers having a first dielectric constant, and the second layer having a second dielectric constant, wherein the second dielectric constant is distinct from the first dielectric constant.

5. The antenna assembly of claim 1, wherein a flexible circuit comprising one or more conductive traces is attached to the antenna assembly for providing one or more of: voltage, current, and control signals to components attached to the antenna assembly.

6. A method of manufacturing an antenna assembly for use in a wireless device, comprising the steps of:

using a first plating-resistive and non-conductive material to form a first carrier having one or more first voids on an outer surface thereof;

filling a volume of the first voids with a first plating-friendly filler material;

on the first filler material, attaching one or more first plating resists adapted to resist conductive plating;

forming first conductive patterns by plating a first conductive material on the plating-friendly first filler material, wherein each of the first plating resists forms a first discontinuous part of the conductive patterns; and attaching at least one first surface mounted device to the first conductive patterns at one of the first discontinuous parts; and using a second plating-resistive and non-conductive material to form a second carrier having one or more second voids on an outer surface thereof;

filling a volume of the second voids with a second plating-friendly filler material;

on the second filler material, attaching one or more second plating resists adapted to resist conductive plating;

forming second conductive patterns by plating a second conductive material on the plating-friendly second filler material, wherein each of the second plating resists forms a second discontinuous part of the conductive patterns; and attaching at least one second surface mounted device to the second conductive patterns at one of the second discontinuous parts.

7. The method of claim 6, wherein said attaching the surface mounted device comprises:

aligning terminal ends of the surface mounted device on the conductive pattern and interposing a solder bump therebetween; and passing through a reflow oven having a temperature sufficient to melt the solder bump to connect the terminal ends of the surface mounted device with the conductive pattern through the solder bump.

8. The antenna assembly of claim 3 comprising three or more layers.

9. The antenna assembly of claim 3, wherein at least a portion of the second conductive pattern is connected with the first conductive pattern of the first layer.

10. The antenna assembly of claim 8, wherein at least one of said three or more layers comprises a laser directed structure.

11. The antenna assembly of claim 10, wherein said laser directed structure is positioned above the first layer.

12. The antenna assembly of claim 10, wherein said laser directed structure is positioned below the first layer.

13. The antenna assembly of claim 3, at least one of said first and second layers comprising one or more parasitic conductors disposed thereon.

14. The antenna assembly of claim 1, the plating resist being disposed on the filler material at one of: a feed portion or a ground portion of the conductive pattern;

wherein the surface mounted device comprises one of: a capacitor, inductor, resistor, diode, active component, switch, or a combination thereof.

15. The antenna assembly of claim 1, the plating resist being disposed on the filler material at one of a plurality of radiating portions of the conductive pattern;

wherein the surface mounted device comprises: an active component or a switch.

16. The antenna assembly of claim 1, further comprising a second surface mounted device disposed at a second discontinuous part being formed at one of a plurality of radiating portions of the conductor pattern, wherein said second surface mounted device comprises one of: a capacitor, inductor, resistor, diode, active component, switch, or a combination thereof.

17. The antenna assembly of claim 1, comprising:

a first plating resist being disposed on the filler material at a feed portion of the conductive pattern, the first plating resist forming a first discontinuous part of the conductive pattern, wherein a first surface mounted device is disposed thereon;

a second plating resist being disposed on the filler material at a ground portion of the conductive pattern, the second plating resist forming a second discontinuous part of the conductive pattern, wherein a second surface mounted device is disposed thereon; and a third plating resist being disposed on the filler material at a feed portion of the conductive pattern; the third plating resist forming a third discontinuous part of the conductive pattern, wherein a third surface mounted device is disposed thereon.

18. An antenna assembly for use in wireless devices, comprising:

a first layer including:

a first carrier formed of non-conductive and plating-resistive resin material, and having one or more first voids disposed on an outer surface thereof;

a first plating-friendly filler material spanning a volume created by the first voids on the outer surface of the first carrier;

first conductive material disposed on a plated surface of the first filler material forming a first conductive pattern;

at least one first plating resist disposed on the first filler material forming a first discontinuous part of the first conductive pattern; and at least one first surface mounted device attached to the first conductive pattern at one of said first discontinuous parts; and at least a second layer including:

a second carrier formed of non-conductive and plating-resistive resin material, and having one or more second voids disposed on an outer surface thereof;

a second plating-friendly filler material spanning a volume created by the second voids on the outer surface of the second carrier;

second conductive material disposed on a plated surface of the second filler material forming a second conductive pattern;

at least one second plating resist disposed on the second filler material forming a second discontinuous part of the second conductive pattern; and at least one second surface mounted device attached to the second conductive pattern at one of said second discontinuous parts;

wherein said first layer is coupled to said second layer to form a multi-layer antenna assembly.

19. The antenna assembly of claim 18, wherein at least one of said first and second layers comprises one or more parasitic conductors disposed thereon.

20. The antenna assembly of claim 18, each of said first and second surface mounted devices individually comprising one or a plurality of: capacitors, inductors, resistors, diodes, active components, switches, or a combination thereof.

21. The antenna assembly of claim 18, said first conductive pattern comprising a feed portion, a ground portion, and two or more radiating portions;

wherein a one of the at least one first surface mounted devices is disposed at one of the feed portion or the ground portion for adjusting a reactance thereof; and wherein another of the at least one first surface mounted devices is disposed at one of the two or more radiating portions for one of: reactively loading said one of the two or more radiating portions, actively connecting and disconnecting said one of the two or more radiating portions, or a combination thereof.

* * * * *